US005749706A

United States Patent [19]

Maar

[11] Patent Number: 5,749,706

[45] Date of Patent: May 12, 1998

[54] TURBINE BLADE WHEEL ASSEMBLY WITH ROTOR BLADES FIXED TO THE ROTOR WHEEL BY RIVETS

[75] Inventor: Karl Maar, Pfaffenhofen, Germany

[73] Assignee: MTU Motoren- und Turbinen-Union Muenchen GmbH, Munich, Germany

[21] Appl. No.: 794,191

[22] Filed: Jan. 24, 1997

[30] Foreign Application Priority Data

Jan. 31, 1996 [DE] Germany ..... 196 03 388.8

[51] Int. Cl.[6] ..... F01D 5/32

[52] U.S. Cl. ..... 416/220 R; 29/512; 29/525.06; 29/889.21

[58] Field of Search ..... 416/193 A, 220 R, 416/221, 248; 29/525.06, 525.05, 512, 889.21; 411/15, 501

[56] References Cited

U.S. PATENT DOCUMENTS

| | | | |
|---|---|---|---|
| 2,753,149 | 7/1956 | Kurti . | |
| 2,971,744 | 2/1961 | Szydlowski . | |
| 2,980,395 | 4/1961 | Rubbra et al. . | |
| 3,395,891 | 8/1968 | Burge et al. . | |
| 3,666,376 | 5/1972 | Damlis . | |
| 4,029,436 | 6/1977 | Shoup, Jr. et al. . | |
| 4,191,509 | 3/1980 | Leonardi . | |
| 4,279,572 | 7/1981 | Auriemma . | |
| 4,343,594 | 8/1982 | Perry . | |
| 4,505,640 | 3/1985 | Hsing et al. . | |
| 5,651,172 | 7/1997 | Auriol et al. | 29/512 |

FOREIGN PATENT DOCUMENTS

| | | | |
|---|---|---|---|
| 950557 | 7/1955 | Germany . | |
| 1033676 | 7/1958 | Germany . | |
| 3008889 | 9/1980 | Germany . | |
| 2853856 | 4/1987 | Germany . | |
| 19516694 | 11/1996 | Germany . | |
| 62-55402 | 3/1987 | Japan | 416/221 |
| 850979 | 10/1960 | United Kingdom . | |
| 1213408 | 11/1970 | United Kingdom . | |

*Primary Examiner*—Christopher Verdier
*Attorney, Agent, or Firm*—W. G. Fasse; W. F. Fasse

[57] ABSTRACT

Rotor blades (1) are held by means of toothed roots (3) in correspondingly profiled axial grooves (4) of a rotor wheel rim (5). Between each root end and the base of an axial groove (4), there is formed a radial gap (S) accommodating a rivet (6). Each rivet (6) is centrally guided on two inserts (9, 9') resting against the base of the axial groove (4) in the radial gap (S) and having bent or angled end parts (10, 10') resting against the front and rear faces of the wheel rim (5). Seating wedges (11, 11') surround the upset head (8) and the set head (7) of the rivet (6) and are axially and radially clamped to wedge-shaped complementary surfaces (G, G') of the root end and of the respective insert (9, 9') by riveting. As a result, an improved radial and axial clamping of the rotor blades is achieved.

20 Claims, 1 Drawing Sheet

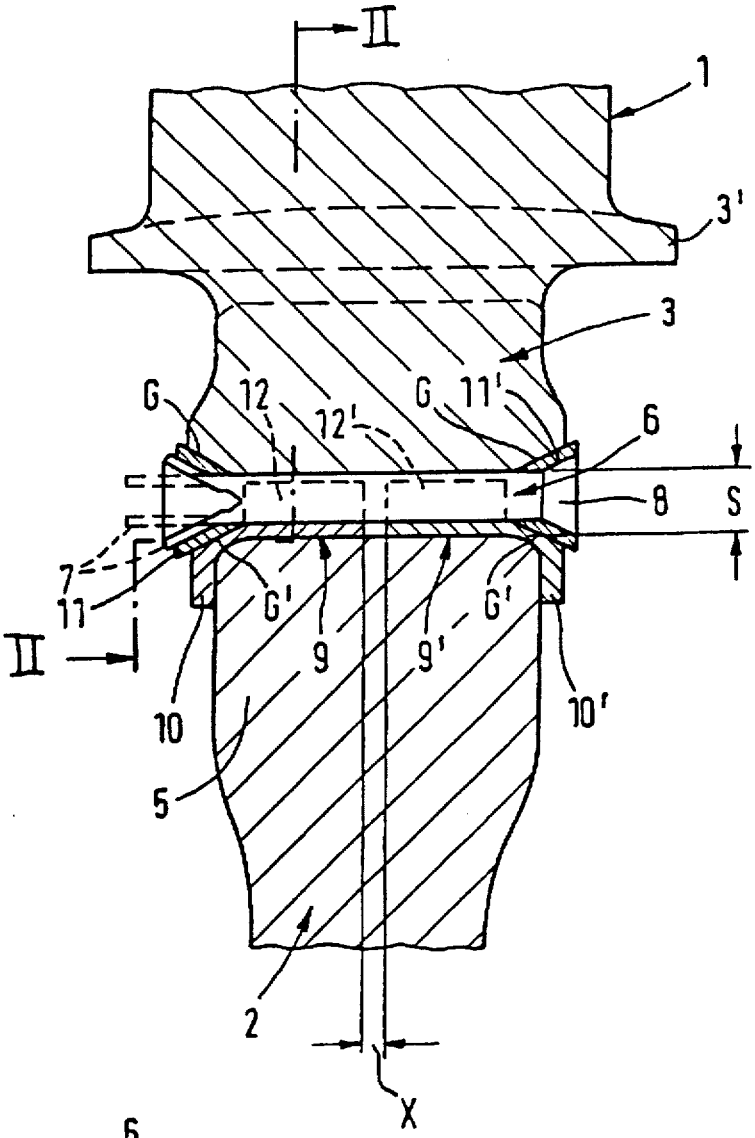
FIG. 1
FIG. 2
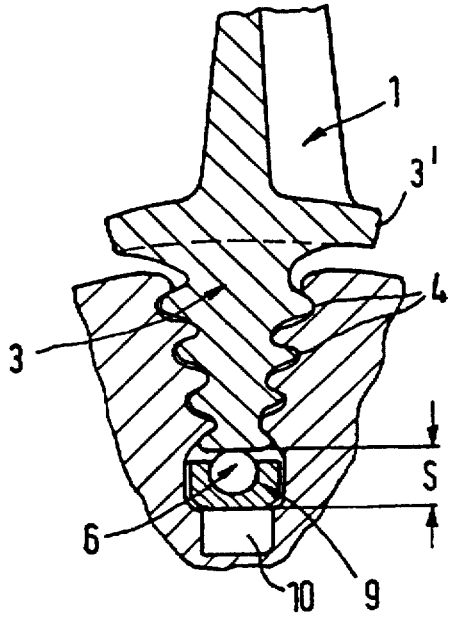
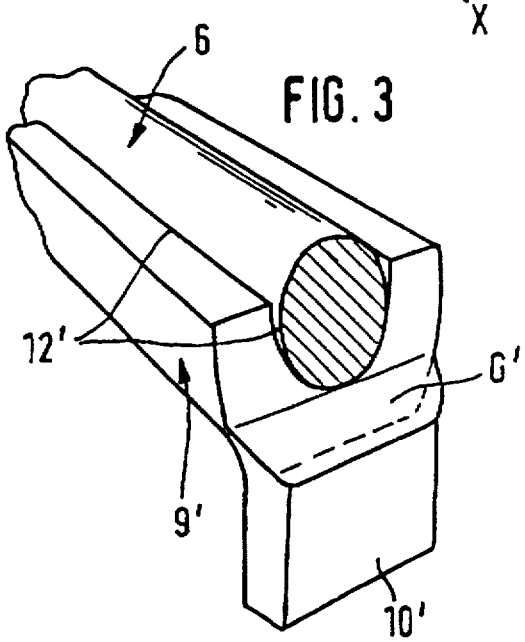
FIG. 3

TURBINE BLADE WHEEL ASSEMBLY WITH ROTOR BLADES FIXED TO THE ROTOR WHEEL BY RIVETS

FIELD OF THE INVENTION

The invention relates to a rotor blade wheel assembly, for example of a turbine engine or compressor, comprising a plurality of rotor blades fixed to a blade wheel by riveting, wherein each rotor blade has a toothed root engaged in a correspondingly toothed axial groove of a wheel rim, wherein a radial gap is formed between each root end and the base of the axial groove, and wherein the rivet extends axially in the radial gap and has a closing head or upset head at one end thereof and a set head at the other end thereof.

BACKGROUND INFORMATION

In a known rivet-fixed blade wheel assembly, especially in a turbine of a gas turbine engine, the rivet rests directly on the floor or base of the groove in the radial gap and is guided and supported in a channel provided at the end of the blade root. Conical recesses are formed directly in the material of the blade root and the wheel rim on both sides thereof and are provided for receiving the heads of the rivet, i.e. the conical set head and the upset head that is to be conically expanded or swaged. This gives rise to a complex manufacturing process with considerable wastage. Even minor errors in the formation of the recesses render the extremely expensive components, i.e. the blades and the wheel disc, unusable. There is also considerable danger of parts of the blade roots and the wheel rim being damaged during assembly or riveting, and in particular during disengagement of the riveted connection, for example if the shaped upset head is to be machined-off or removed by boring. Jointly removing the blade and the rivet from the axial groove can also cause damage to the groove base.

Even slight manufacturing inaccuracies, and the fact that the recess is formed in different components, i.e. the roots and the wheel rim, give rise to the danger of comparatively premature settling and loosening of the riveted connection. In this regard, different thermal and mechanical stresses on the blade roots and the wheel rim also have to be taken into consideration. The blades are also subjected to relative, independent stresses caused by centrifugal and gas forces. This can lead to a changed blade alignment and an imbalance of the blade wheel assembly.

With respect to the connection between the blades and the wheel disc, it is also desirable or advantageous to achieve the following features. A radial surface pressure should be provided between the teeth of the blade roots and the complementary surfaces on the teeth of the axial grooves. The installation clearance or play normally present between complementary tooth flanks should be practically eliminated or used-up already in the finally assembled state, in the interest of an improved balancing procedure and results, in particular with respect to the use of a blade-shroud mounting. In such a mounting, the blades will normally (i.e. when they are fixed axially) only reach their optimum operating position at a particular operating state or turbine speed at which the installation clearance is finally elimated. When the blades are only fixed axially, e.g. by a sheet metal strip or plate securing means, without radial surface pressure, the shroud mounting would produce irregular blade seat positions, such that an optimum rotor balancing would consequently be impossible.

SUMMARY OF THE INVENTION

An object of the invention is to provide a blade wheel assembly that is easily assembled by riveting, with a low risk of damage to the components, and that also achieves an optimum frictional and positive form-locking connection of the rotor blades to the wheel disc in the axial and radial directions, taking into consideration comparatively long periods of operation. Further objects of the invention are to avoid the above discussed disadvantages of the prior art and to achieve the advantages that will be discussed below.

The above objects have been achieved in a rotor blade wheel assembly of the above-described general type, particularly according to the invention, wherein the rotor blades are secured to the wheel using rivets as well as special inserts and seating wedges. Each rivet is centrally located on two inserts having outer contours that substantially conform to the inner contour of the radial gap between the blade root end and the base of the axial groove in the wheel rim, and that especially substantially match an inner contour of at least a radially inner portion of the axial groove. The inserts rest on the base of the axial groove, and respectively each have an end part angled toward the wheel axis, which end part rests against the front and rear axial end faces of the wheel rim. A respective seating wedge or wedge-shaped seating collar surrounds the upset head and the set head of each rivet in the manner of a collar. The seating wedges are axially and radially clamped by the finished rivet to wedge-shaped complementary angled seating surfaces of the blade root end and of the respective insert.

The inventive arrangement and production of the riveted connection require no appreciable changes to the wheel rim and the blades.

Owing to the wedging action of the seating wedges relative to the inclined complementary surfaces of the end of the blade root and the respective inserts, the riveting produces an axial and radial clamping effect. Thereby, the inserts and the blade roots are radially and axially fixed to the wheel rim. The roots of the rotor blades are fixed to the axial groove not only axially, but also with their tooth flanks pressed radially against the complementary flanks of the groove teeth. This axial and radial clamping effect is already achieved once the assembly is completed, namely when the wheel disc is idle or stationary. Thus, this fixed state without any installation clearance or play is not only achieved once a particular operating state (rotational speed, centrifugal force) has been reached, but rather is already achieved initially upon assembly. Any rotor imbalances can be eliminated more accurately and more quickly by using a shroud mounting at the blade tips, which is possible according to the invention, because such an arrangement can no longer force an "abnormal" or irregular blade seat position below this operating state or at an extremely low rotational speed.

The inserts ensure that the rivet is accurately guided or centered in the radial gap. Their preferred axially spaced-apart arrangement in the radial gap, particularly with a spacing gap X therebetween, permits a limited relative displacement of the inserts, e.g. to compensate for mechanical and thermally induced effects on the components (differential expansion) or for rivet compression, which can occur during riveting. This effect is based on the inserts having a certain installation clearance relative to the installation cross-section in the radial gap. If the inserts have a comparatively small installation clearance and are sufficiently rigidly constructed, and with a zero transverse clearance or play in the recesses in the inserts, then a rivet compression upset can advantageously be converted into an upset deformation of the rivet shaft directed toward the root end in order to achieve or promote radial contact pressure of the blade teeth against corresponding tooth flanks of the axial groove.

If the rivet is accurately accommodated and guided in a groove, channel or recess in the inserts, then the blade root can rest entirely against the rivet with a contact that is unaffected by the inserts. More particularly, the rivet is received in the channel of the insert with at least a portion of a circumference of the rivet shaft recessed into the channel, and especially only with a portion of the shaft circumference recessed and a portion thereof exposed or protruding from the channel.

The seating wedges prevent damage to locally adjacent root and wheel-rim portions, in particular at the upset head of the rivet, during the riveting and also during disassembly, for example removal by a boring tool. When the blade and the rivet are jointly driven out of the axial groove during disassembly, the inserts, which are held resting axially together on the wheel rim, prevent damage to the base of the groove.

Preferably, the seating wedges each have an axial bore for receiving a shank or shaft portion of the rivet, in a portion of the respective seating wedge projecting axially into the radial gap. Furthermore, each seating wedge widens to form a conical countersink collar opening axially outwardly from the axial bore and substantially conforming to the conical contour of the set head or the shaped upset head, respectively. Through the axial bores in the seating wedges, the latter can be subjected to a respectively inwardly directed clamping movement on the rivet, directed against straight end surfaces of the inserts.

BRIEF DESCRIPTION OF THE DRAWINGS

In order that the invention may be clearly understood, it will now be described, by way of example, with reference to the accompanying drawings, wherein:

FIG. 1 is a longitudinal section showing a part of a blade wheel assembly in accordance with the invention, in the region of the connection between the rotor blade and the wheel disc, wherein the rivet is shown in non-sectional side view;

FIG. 2 is a detailed view predominantly in section along the line II—II of FIG. 1; and FIG. 3 is a perspective view taken from the right-hand side of FIG. 1 and showing part of the insert, with a part of the rivet received in a groove in the insert being shown in section.

DETAILED DESCRIPTION OF PREFERRED EXAMPLE EMBODIMENTS AND OF THE BEST MODE OF THE INVENTION

As shown in the drawings, a wheel rim 5 of a blade wheel or a wheel disc 2 of an axial-flow turbine or a compressor is fitted with a plurality of rotor blades 1 uniformly distributed over the circumference of the rim, wherein only one rotor blade 1 is shown in FIG. 1. Each rotor blade 1 has a multi-toothed, symmetrically profiled blade root 3 by means of which the rotor blade is anchored in a correspondingly formed toothed profile of an associated axial groove 4 of the wheel rim 5, as shown especially in FIG. 2. The blade root 3 extends radially inwardly from a root plate 3' of the rotor blade 1. The blade root 3 has teeth on both sides and overall tapers radially inwardly substantially in the shape of a wedge from the top (radially outside) to the bottom (radially inside). In terms of art, a blade root 3 of this type is also described as a "fir-tree root" or as "fir-cone-shaped".

In the arrangement described above, there is a radial gap S formed between the radially inner end of the blade root 3 and the base or floor of the axial groove 4, as shown particularly in FIGS. 1 and 2. For simultaneously axially and radially securing or fixing the rotor blades 1 to the wheel rim 5 via the axial grooves 4, the invention provides a riveted connection using a rivet 6 having an upset head 7 at one end and a set head 8 at the other end, as shown in FIG. 1. The shank or shaft of the cylindrical rivet 6 extends in the longitudinal direction in the radial gap S. The set head 8 is pre-formed to have a conically tapered shape that seats and extends into one end of the radial gap S. The upset head 7 is formed by a sleeve part that is shown by dashed lines in its initial, undeformed, i.e. non-upset, state extending axially outwardly from the other end of the radial gap S, and is shown by solid lines in its finished, deformed state conically tapering and extending axially into the other end of the radial gap S.

The blade fixing arrangement also includes two inserts 9, 9' resting on the base of the axial groove 4 in the radial gap S, axially spaced apart from one another by a gap X, as shown in FIG. 1. Each insert 9, 9' has an end part 10, 10' that is bent or angled radially inward toward the wheel axis. The end parts 10, 10' could also be described as shoulders, lugs or tabs. One insert 9 rests axially against the front of the wheel rim 5 by means of the end part 10, and the other insert 9' rests against the rear of the wheel rim 5 by means of the end part 10'.

It can also be seen from FIG. 1 that the upset head 7 and the set head 8 of the rivet 6 are each surrounded by a respective seating wedge 11, 11' in the manner of a sleeve or collar at the front and rear ends of the radial gap S. By means of a circumferential surface tapering conically toward the interior of the radial gap, the set head 8 rests against a corresponding conical inner surface of the respective seating wedge 11'. At the upset head 7, the other seating wedge 11 has an inner surface tapering conically toward the interior of the radial gap, and the sleeve end of the upset head 7 is deformed against this inner surface by upsetting or riveting from the initial position shown by dashed lines into the conical seating position shown by solid lines. This can be carried out using a suitably preformed riveting tool, while the set head 8 is subjected to a counterforce by means of a counter tool when the riveting is carried out by impact deformation.

At both ends of the radial gap S, the seating wedges 11, 11' rest against respective radially spaced, wedge-shaped complementary surfaces G, G' of the root end and of the respective insert 9, 9' and are axially and radially clamped against the surfaces G, G' as a result of the riveting process, as shown in FIG. 1. In this way, the root 3 of the rotor blade 1 is not only axially secured on the wheel rim 5, but is also radially fixed in the axial groove 4, as shown in FIG. 2. Namely, the teeth of the blade root 3 are radially pressed against the teeth of the axial groove 4.

The shank or shaft of the rivet 6 extends along channels or recesses 12, 12' in the inserts 9, 9' substantially concentrically with its longitudinal axis, the recesses 12, 12' being upwardly and outwardly open and being shown transparently with dashed lines on one side only in FIG. 1. In the illustrated embodiment, the channels 12, 12' have respective semi-circular or U-shaped cross sectional shapes. Part of the circumference of the rivet 6 projects upwardly and outwardly out of the respective axial groove 12, 12', as can also be seen clearly from FIG. 3 in relation to one insert 9'. Along its radially projecting circumferential part, the rivet 6 is supported against the radially inner end of the blade root 3. In this embodiment, the blade root end is a substantially flat surface, and does not require a recess or groove therein for receiving the shaft of the rivet 6. Owing to the arrangement of the rivet 6 in the recesses 12, 12' of the inserts 9, 9', the installed, axial position of the rivet 6 is slightly radially displaced outwardly and upwardly relative to the longitudinal center of the radial gap S.

Instead of the recesses 12, 12' shown, longitudinal channels, longitudinal grooves or depressions having a V-shaped or U-shaped cross-section may be provided, in or along which the rivet extends and is guidingly supported at least along part of its circumference. The rivet 6 could be completely sunken or recessed into the upwardly open U-shaped recesses, for example.

As shown in FIG. 1, the seating wedges 11, 11' have axial bores for receiving the cylindrical shank portion of the rivet 6 in the front and rear regions projecting axially inwardly into the radial gap S. Starting from these bores, the seating wedges 11, 11' are each widened axially outwardly to form conical counter-sink collars, one of which receives the conical set head 8, and the other of which at the end opposite the set head 8 receives the upset head 7 that has been conically deformed by riveting.

As can be seen from FIG. 1, the region of the blade root 3 forming the wedge-shaped complementary surfaces G for the seating wedges 11, 11' is axially thicker than the wheel rim 5. In other words, the side or end faces of the blade root 3 protrude axially beyond the side or end faces of the wheel rim 5 as shown in FIG. 1. While this is an optional feature of the invention, this thickening of the blade root 3 is compensated for by the angled end parts 10, 10' of the inserts 9, 9' on the wheel rim 5, since the radially inner, conical complementary surfaces G' are formed on the end parts 10, 10'.

Assembly of the present arrangement is carried out as follows. First, the root 3 of the rotor blade 1 is inserted axially into the axial groove 4 to form the radial gap S. Two inserts 9, 9' are inserted from outside into the radial gap S and each rests axially via the angled end parts 10, 10' against one end of the wheel rim 5. Two seating wedges 11, 11' are then anchored to the respective wedge-shaped complementary surfaces G, G'. The rivet 6 is now pushed axially from right to left in FIG. 1, with its axially extended sleeve part for forming the upset head 7 and its shaft, through one seating wedge 11', then through the two recesses 12', 12 in the inserts 9', 9 and finally through the other seating wedge 11. Riveting is then carried out by conically deforming the upset head 7. In this context, the two inserts 9, 9' prevent the base of the groove from being damaged already during assembly, wherein an axial seating pressure, counter to the direction of insertion, is mechanically applied to one insert 9.

For the purposes of disassembly, the conically shaped part of the upset head 7 is first removed, e.g. by a boring tool. Then, the rotor blade 1, together with the root 3 and the rivet 6, is withdrawn from the axial groove 4 from left to right in FIG. 1, while the two inserts 9, 9' are held resting axially against the wheel rim 5, thus preventing damage to the base of the axial groove 4.

In contrast to the example embodiment shown in FIG. 1, the invention can also be executed in such a manner that the upset head 7 is arranged on the right-hand side of the radial gap S and the set head 8 is arranged on the left-hand side of the radial gap S.

Although the invention has been described with reference to specific example embodiments, it will be appreciated that it is intended to cover all modifications and equivalents within the scope of the appended claims. It is also within the scope of the invention to combine the features of any two or more of the dependent claims with each other, to the extent they are not incompatible, in any combination as desired.

What is claimed is:

1. A rotor blade wheel assembly comprising a rotor wheel having a plurality of toothed axial grooves that include groove teeth and that are arranged on a circumference of a wheel rim thereof, a plurality of rotor blades respectively having toothed blade roots that include root teeth and that are respectively engaged in said toothed axial grooves, with a respective radial gap between a radially inner root end of each said blade root and a floor of each said axial groove, two respective inserts arranged on each said axial groove floor in each said radial gap, two respective wedge-shaped seating collars respectively arranged at two opposite axial ends of each said radial gap, and seated against respective wedge-shaped angled seating surfaces provided on said inserts and on said blade roots adjacent each said radial gap, and a respective rivet arranged in each said radial gap, wherein each said rivet has a shaft guidedly extending along and in contact with said two inserts in said radial gap, and first and second rivet heads at two opposite axial ends of said shaft seated against and surrounded by said two respective seating collars such that said rivet heads clamp said two respective seating collars axially and radially against said respective wedge-shaped angled seating surfaces.

2. The rotor blade wheel assembly of claim 1, wherein said wheel assembly is a turbine wheel assembly of a gas turbine engine.

3. The rotor blade wheel assembly of claim 1, wherein said inserts each respectively have an outer contour that substantially matches an inner contour of at least a radially inner portion of said axial groove.

4. The rotor blade wheel assembly of claim 1, wherein each said insert includes an insert body extending along said axial groove floor and an end part angled from said insert body toward a wheel axis of said rotor wheel, and wherein each said insert is arranged with said respective end part seated against a respective axial end face of said wheel rim adjacent said axial groove.

5. The rotor blade wheel assembly of claim 4, wherein said two respective inserts are respectively held with an axial spacing between one another in each said radial gap by said end parts seated against said axial end faces of said wheel rim.

6. The rotor blade wheel assembly of claim 5, wherein said two respective inserts each have a channel extending axially in a radially outer surface thereof, wherein said channel is open toward said blade root end, and said shaft of said rivet extends along and is received in said channel with at least a portion of a circumference of said shaft recessed into said channel.

7. The rotor blade wheel assembly of claim 6, wherein said first and second rivet heads respectively each have a conically tapering contact surface, and wherein said wedge-shaped seating collars respectively each have an axial hole with said shaft of said rivet received extending therethrough and a collar body that extends and widens axially outwardly from said axial hole to form a conical countersink surface substantially matching said conically tapering contact surface of said rivet heads.

8. The rotor blade wheel assembly of claim 7, wherein said blade roots have a first axial thickness measured between axial end faces thereof adjacent said wedge-shaped angled seating surfaces thereof that is greater than a second axial thickness of said wheel rim measured between said axial end faces thereof adjacent said axial grooves, and wherein said end parts of said inserts seated against said axial end faces of said wheel rim compensate for a difference between said greater first axial thickness and said second axial thickness.

9. The rotor blade wheel assembly of claim 4, wherein said two respective inserts each have a channel extending axially in a radially outer surface thereof, wherein said channel is open toward said blade root end, and said shaft of said rivet extends along and is received in said channel with at least a portion of a circumference of said shaft recessed into said channel.

10. The rotor blade wheel assembly of claim 9, wherein only a portion of said circumference of said rivet shaft is recessed into said channel, and another portion of said circumference protrudes radially outwardly beyond said radially outer surface of said insert and contacts said blade root end.

11. The rotor blade wheel assembly of claim 9, wherein said channel has a substantially semicircular cross-section.

12. The rotor blade wheel assembly of claim 4, wherein said first and second rivet heads respectively each have a conically tapering contact surface, and wherein said wedge-shaped seating collars respectively each have an axial hole with said shaft of said rivet received extending therethrough and a collar body that extends and widens axially outwardly from said axial hole to form a conical countersink surface substantially matching said conically tapering contact surface of said rivet heads.

13. The rotor blade wheel assembly of claim 4, wherein said blade roots have a first axial thickness measured between axial end faces thereof adjacent said wedge-shaped angled seating surfaces thereof that is greater than a second axial thickness of said wheel rim measured between said axial end faces thereof adjacent said axial grooves, and wherein said end parts of said inserts seated against said axial end faces of said wheel rim compensate for a difference between said greater first axial thickness and said second axial thickness.

14. The rotor blade wheel assembly of claim 4, wherein said rivet shaft and said inserts together completely span a radial dimension of said radial gap with said inserts bracing radially against said axial groove floor and said rivet shaft bracing radially against said blade root end, so that said root teeth of said toothed blade root are radially locked without play against said groove teeth of said toothed axial groove.

15. The rotor blade wheel assembly of claim 1, wherein said rivet shaft and said inserts together completely span a radial dimension of said radial gap with said inserts bracing radially against said axial groove floor and said rivet shaft bracing radially against said blade root end, so that said root teeth of said toothed blade root are radially locked without play against said groove teeth of said toothed axial groove.

16. The rotor blade wheel assembly of claim 1, wherein said clamping of said seating collars axially and radially against said respective wedge-shaped angled seating surfaces by said rivet heads radially stresses said toothed blade root so that said root teeth of said toothed blade root are radially locked without play against said groove teeth of said toothed axial groove.

17. The rotor blade wheel assembly of claim 4, wherein said insert body is substantially in the form of a semicircular sleeve, and said end part is a flat tab extending substantially perpendicularly from said semicircular sleeve, with an angled shoulder forming a transition connection between said sleeve and said tab and having a respective one of said wedge-shaped angled seating surfaces formed thereon.

18. The rotor blade wheel assembly of claim 1, wherein each said radially inner end of said blade root is respectively a substantially flat surface without a rivet-receiving recess therein.

19. A method of assembling the rotor blade wheel assembly of claim 1, comprising the following steps:

axially sliding said blade roots respectively into said axial grooves and thereby forming said radial gaps, inserting said two respective inserts axially into each said radial gap from opposite axial ends thereof, arranging said two respective seating collars at said opposite axial ends of each said radial gap, inserting a rivet blank, which includes said shaft with said first rivet head at a first end thereof and a deformable end portion at a second end thereof, into each said radial gap by pushing said deformable end portion through a first one of said two collars, along said two respective inserts in said gap, and through a second one of said two collars, and deforming each said deformable end portion to respectively form said second rivet heads, such that said respective first and second rivet heads clamp said two respective seating collars axially and radially against said respective wedge-shaped angled seating surfaces.

20. A blade wheel assembly comprising a plurality of rotor blades fixed to a blade wheel by riveting, each rotor blade having a toothed root engaged in a correspondingly toothed axial groove of a wheel rim, there being a radial gap between each root end and the base of the axial groove, the rivet extending axially in the radial gap and having a closing head at one end thereof and a set head at the other end thereof, wherein:

each rivet is centrally located on two inserts having outer contours substantially conforming to the inner contour of the radial gap, the inserts resting on the base of the axial groove;

the inserts rest against the front and rear of the wheel rim respectively by means of an end part angled towards the wheel axis;

the closing head and the set head of each rivet are surrounded by a respective seating wedge in the manner of a collar;

the seating wedges are axially and radially clamped by riveting to wedge-shaped complementary surfaces of the root end and the respective insert.

* * * * *